United States Patent [19]

Bowditch

[11] Patent Number: 4,532,655

[45] Date of Patent: Aug. 6, 1985

[54] METHOD OF GENERATING A PATTERN OF A FLAT SEAM GARMENT

[75] Inventor: Philip N. Bowditch, Cohasset, Mass.

[73] Assignee: The Charles Stark Draper Laboratory, Inc., Cambridge, Mass.

[21] Appl. No.: 565,377

[22] Filed: Dec. 27, 1983

Related U.S. Application Data

[62] Division of Ser. No. 500,080, Jun. 1, 1983, Pat. No. 4,510,626.

[51] Int. Cl.[3] ..... A41D 27/00

[52] U.S. Cl. ..... 2/243 B; 2/DIG. 7; 2/113; 2/125; 33/17 A; 33/17 R

[58] Field of Search ..... 2/115, 125, DIG. 1, 2/109, 113, 114, DIG. 7, 90, 243 B; 33/17 R, 17 A

[56] References Cited

U.S. PATENT DOCUMENTS

| | | | |
|---|---|---|---|
| D. 233,634 | 11/1974 | Snider | 2/DIG. 7 |
| 2,701,364 | 2/1955 | Pahn | 2/114 |
| 2,792,572 | 11/1954 | Rosenbaum et al. | 2/90 |
| 3,129,432 | 4/1962 | Belkin | 2/114 |
| 3,470,568 | 3/1968 | Belkin | 2/114 |
| 4,205,446 | 6/1980 | Gibson | 33/17 R |

FOREIGN PATENT DOCUMENTS

| | | | |
|---|---|---|---|
| 1096753 | 6/1955 | France | 33/17 R |
| 955868 | 4/1964 | United Kingdom | 33/17 A |
| 961648 | 9/1982 | U.S.S.R. | 33/17 R |
| 971237 | 11/1982 | U.S.S.R. | 33/17 R |

*Primary Examiner*—Werner H. Schroeder
*Assistant Examiner*—Mary A. Ellis
*Attorney, Agent, or Firm*—Lahive & Cockfield

[57] ABSTRACT

A method for converting a pattern for a first garment to a pattern for a second garment, where the first garment includes front and back, body and shoulder portions with sleeves extending from shoulder holes between those front and back portions. The regions of the body and shoulder portion adjacent to the sleeve-to-shoulder seam are non-parallel with respect to regions of the sleeve portions adjacent to that seam when the body and shoulder portions are positioned in a plane. The second garment has the same outer contour as the first garment, including front and back body portions with a shoulder hole between those front and back body portions. Separate, generally tubular sleeve and shoulder portions having a sleeve and shoulder seams extending along their lengths, have one end joined to the perimeters of the shoulder holes along shoulder-to-body seams. These seams are positioned so that the regions of the body portions adjacent to the shoulder-to-body seams are substantially parallel to the regions of the shoulder and sleeve portion adjacent to those shoulder-to-body seams when the regions of the body portion are positioned in a plane without the sleeve seams being joined.

2 Claims, 8 Drawing Figures

METHOD OF GENERATING A PATTERN OF A FLAT SEAM GARMENT

This is a division, of application Ser. No. 500,080, filed June 1, 1983 now U.S. Pat. No. 4,510,626.

BACKGROUND OF THE INVENTION

The present invention is in the field of clothing and more particularly relates to the design and assembly of garments.

Garments have long been made by joining two or more panels of limp fabric to form seams, so that the composite surface of the joined panels forms a desired three dimensional contour. Typically, the design process for a garment includes the step of segmentation of the desired finished contour into planar patterns having shapes corresponding to panels for the garment. These patterns are used to generate the panels which may be cut from a portion of a limp fabric while that portion is positioned in a plane.

Thus, to manufacture the garment using the pattern, the pattern are used to define the contours of the panels on a portion of fabric, and the panels are cut from that portion. Thereafter, the cut panels are joined to form the garment. In order to efficiently produce large numbers of garments, for example in commercial production, the panels may be cut from elongated strips of fabric extending from bolts of the fabric. Various computer controlled systems have been developed in the prior art to accomplish the garment production from such bolts. For example, there are known systems for automatically laying out panels, accommodating a full range of garment sizes, on a strip of material from a bolt which maximizes fabric utilization (i.e. minimizes waste). There are also computer controlled cutting systems, for example using reciprocating knives, which very accurately and quickly cut the panels from a large number of strips at a time. Further, there are systems which can automatically position the cut panels so that certain of their edges-to-be-joined may be joined by sewing, or fusing, under the control of a computer.

One of the principle limitations of the prior art clothing assembly techniques is that automatic, or computer controlled, joining systems can only effectively perform panel edge joining in a flat plane. That is, the seam must lie in a plane. Since many garments include seams which may be formed in a flat plane, automated systems have been very effective in enabling the efficient production of garments. For example, U.S. Pat. No. 3,699,591 shows a system for manufacturing simple garment which includes only flat plane seams which may readily be performed by known systems.

However, most garments must be assembled with at least some seams which are not flat plane seams; that is, the garment design includes seams which cannot be formed in a plane, or at least it is not known how to form such seams in a plane. By way of example, a typical shirt with a raglan or dolman sleeve has a non-flat plane seam joining the sleeve portion to the body portion.

In order to assemble such garments in the prior art, these non-flat plane seams cannot be formed using known automated seam joining systems, but rather must be formed either by hand or, more typically, by human operator-controlled feeding of the panels to the joining hand of a sewing machine (or other type of seam joining) apparatus. Consequently, the labor cost for such garments is relatively high compared to that encountered for a garment which might be assembled entirely by a computer system.

It is an object of the present invention to provide an improved method of clothing design.

It is another object to provide a method of converting a pattern for a garment having non-flat plane seams to a pattern for a garment having a reduced number of non-flat plane seams.

It is yet another object to provide an improved garment.

Still another object is to provide an improved garment having seams which may be joined in a plane.

SUMMARY OF THE INVENTION

Briefly, the present invention is directed to a method for converting a pattern for a first garment to a pattern for a second garment, where the first garment includes front and back body and shoulder portions with a shoulder hole between those front and back portions. By way of example, the front and back portions may be formed from separate panels and joined at their sides, or may be a single panel which is joined at its sides, to form a generally tubular body portion with shoulder holes. Separate generally tubular sleeve portions, having a sleeve seams extending along their lengths, are joined to the perimeters of the shoulder holes at one end of the respective sleeve portions.

The sleeve-to-shoulder seam joining the sleeve portion to the shoulder and body portion is configured so that the regions of the body and shoulder portion adjacent to the sleeve-to-shoulder seam are non-parallel with respect to regions of the sleeve portions adjacent to that seam when the body and shoulder portions are positioned in a plane.

The pattern corresponding to this first garment includes at least one planar pattern (a "first planar pattern") corresponding to the front and back body and shoulder portions when those portions are positioned in a plane, and a "second" planar pattern corresponding to the sleeve portion when positioned in a plane without its sleeve seam being joined.

The second garment includes front and back body portions with a shoulder hole between those front and back bady portions. Separate, generally tubular sleeve and shoulder portions having a sleeve and shoulder seams extending along their lengths, have one end joined to the perimeters of the shoulder holes along shoulder-to-body seams. These seams are positioned so that the regions of the body portions adjacent to the shoulder-to-body seams are substantially parallel to the regions of the shoulder and sleeve portion adjacent to those shoulder-to-body seams when the regions of the body portion are positioned in a plane without the sleeve seams being joined.

The pattern for the second garment includes at least one planar pattern (a "third" planar pattern) corresponding to the front and back body portions positioned in a plane and at least one "fourth" planar pattern corresponding to the sleeve and shoulder portion positioned in a plane without its sleeve and shoulder seam joined.

The garments are configured so that the outer contour of both garments are substantially the same.

According to the invention, the pattern for the second garment may be generated from the pattern of the first garment by the following steps. First, a "fifth" planar pattern is generated from the second planar pattern. That fifth pattern corresponds to the sleeve portion of the first garment in a form modified so that the sleeve seam is adapted to extend from the uppermost point of the shoulder hole. The fifth pattern thus includes an end portion having a perimeter adapted to join the perimeter of the sleeve hole.

Then, the fifth planar pattern is overlayed on the first planar pattern with the center point of the end portion perimeter of the fifth planar pattern being appropriately positioned for its joinder to the lowermost point of the perimeter of the shoulder hole portion of the first pattern, with the first and fifth patterns lying substantially in parallel planes. A reference line is identified in the plane of the first planar pattern, with that reference line being defined by the midpoints of the line segments connecting pairs of associated points on the perimeter of the end portion of the fifth pattern and the perimeter of the shoulder hole of the first pattern. The distance of the points in each pair of associated points from the "center" point and "lowermost" point along the contours defined by the shoulder hole and end perimeters of the first and fifth patterns, respectively, have a fixed ration. In a perferred form, this ratio is 1.

The third planar pattern is generated so that it has an area corresponding to the first patterns less the area between the reference line and the perimeter of the shoulder hole of the first planar patterns.

The fourth planar pattern is generated to have an area corresponding to the fifth planar pattern plus the area between the reference line and the perimeter of the end of the fifth planar patterns which is adapted for joinder to the perimeter of the shoulder hole of the first planar pattern.

According to this method, the third and fourth planar patterns define the panels for the second garment. When the third and fourth planar patterns are placed in an overlying relationship, the edges of those panels may be positioned and joined to form the shoulder-to-body seam substantially in a flat plane.

According to another aspect of the present invention, a garment includes front and back portions with a shoulder hole between those portions. In various embodiments, the front and back portions may be joined at their sides with shoulder holes on each side between those portions. A generally tubular sleeve and shoulder portion having a sleeve and shoulder seam extending along its length has one end of that sleeve and shoulder portion joined to the perimeter of the shoulder hole along a sleeve-to-shoulder seam. This sleeve-to-shoulder seam is appropriately positioned so that regions of the body portions adjacent to the sleeve-to-shoulder seam are substantially parallel to the regions of the sleeve and shoulder portion adjacent to that seam, when the regions of the body portions are positioned in a plane, without these sleeve and shoulder seams being joined.

With this configuration, the garment of the invention may readily be assembled by first joining the sleeve and shoulder portion to the front and back portions without the sleeve and shoulder seam being joined, so that the resulting sleeve-to-shoulder seam may be formed in a flat plane. Subsequently, the sleeve and shoulder seam may also be joined in a flat plane, so that the entire garment may be assembled using only flat plane joining techniques.

BRIEF DESCRIPTION OF THE DRAWINGS

The foregoing and other objects of this invention, the various features thereof, as well as the invention itselg, may be more fully understood from the following description, when read together with the accompanying drawings in which.

DESCRIPTION OF THE PREFERRED EMBODIMENT

Figure 1:
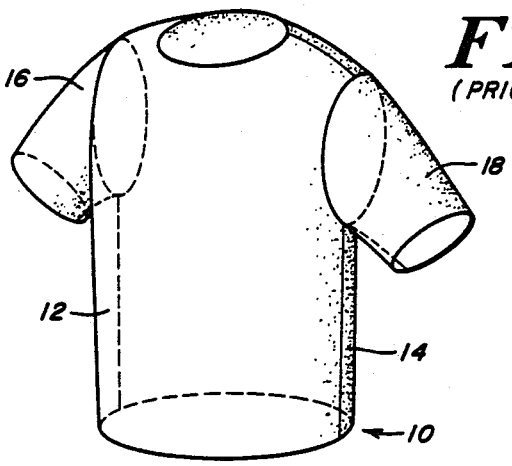
FIG. 1 (PRIOR ART)
FIG. 1 shows a prior art garment.
Figure 2:
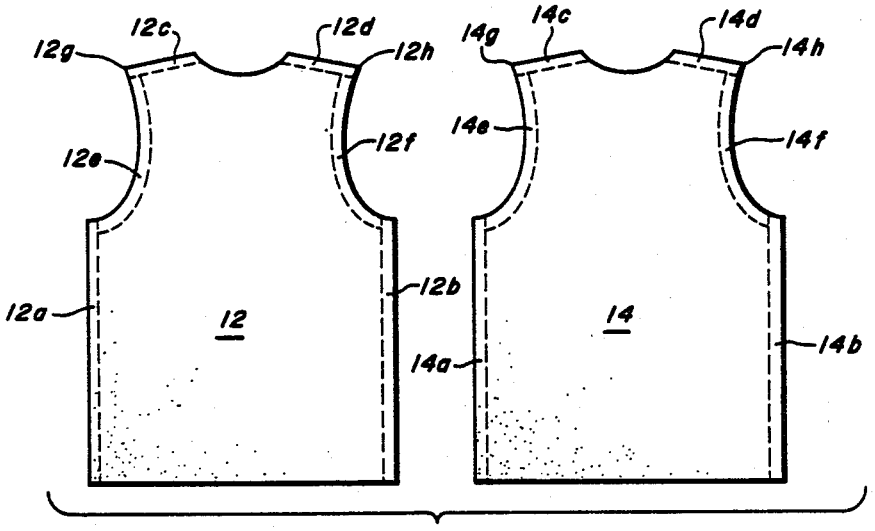
FIG. 2 (PRIOR ART)
FIG. 2 shows front and back panels for the garment of FIG. 1.
Figure 3:
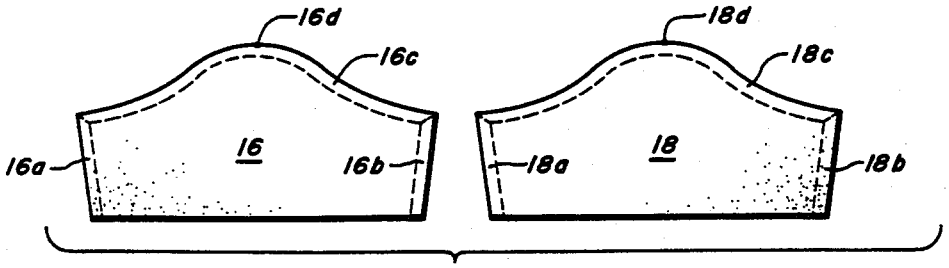
FIG. 3 (PRIOR ART)
FIG. 3 shows sleeve panels for the garment of FIG. 1.

FIG. 1 shows a conventional garment 10, in the form of a T-shirt. FIGS. 2 and 3 show planar patterns for the four panels which make up the garment 10. FIG. 2 includes front panel 12, a back panel 14, and FIG. 3 includes two sleeve panels 16 and 18. The panels 12, 14, 16 and 18 are shown with the regions demarked by dotted lines illustrating the location of desired seams. To assemble the garment 10, using conventional techniques, the regions 12*a*–12*d* are joined to the respective ones of regions 14*a*–14*d*. These operations can be performed using flat plane techniques. Similarly, the regions 16*a* and 16*b* are joined and the regions 18*a* and 18*b* are joined to form the generally tubular sleeves. These operations too may be performed using flat plane techniques.

Then, the sleeves 16 and 18 must be joined to the perimeter of the shoulder holes formed by the respective pairs of perimeter seam regions 12*e*, 14*e* and 12*f*, 14*f*. FIG. 3, the point 16*d* is joined to be joined to the points 12*g* and 14*g*, respectively, of front and back panels 12 and 14. Similarly, the point 18*d* of the sleeve panel 18 is to be joined to points 12*h* and 14*h* of the front and back panels 12 and 14. With this configuration, the seam for the respective sleeves extends from the "arm-pits" of the garment, i.e. from the lowermost points of the shoulder hole. In other embodiments, the sleeve seam may lie in other places. The joining of region 16*c* to regions 12*e* and 14*e* and the seam formed by (sleeve-to-shoulder seam) seam formed by joining region 18*c* to regions 12*f* and 14*f*, cannot be accomplished using conventional flat plane joining techniques.

In accordance with the present invention, a "first" planar pattern corresponding to the panels illustrated in FIG. 2 and a "second" planar pattern corresponding to the panels illustrated in FIG. 3 may be modified to generate a new set of planar patterns (referred to below as "third" and "fourth" planar patterns which may then be joined entirely using flat plane joining techniques to form a garment having substantially the same outer contour as the garment 10 of FIG. 1.

Figure 4:
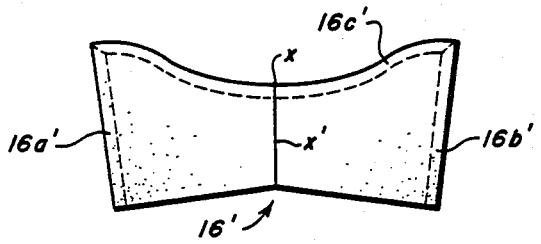
FIG. 4 shows a modified sleeve panel pattern for one of the sleeve panels of FIG. 3.

In order to generate that set of modified patterns, initially, the "second planar pattern for one sleeve is converted to a form for that same sleeve where the sleeve seam extends from the uppermost in the shoulder hole. A converted sleeve pattern 16' (a fifth planar pattern) is shown in FIG. 4 corresponding to the sleeve panel 16. The pattern 16' corresponds to the panel 16 of FIG. 3 but where the sleeve seam (to be formed by portions 16*a*′ and 16*b*′ is to extend from the uppermost point of the shoulder hole. The mid point of the shoulder-to-sleeve portions 16*c*′ is denoted by X. If the pattern 16′ of FIG. 4 were cut along the reference line X′, and the regions 16*a*′ and 16*b*′ were joined, then the pattern 16′ would correspond directly to the panel 16. The other sleeve pattern (not shown) is identical to pattern 16′.

Figure 5:
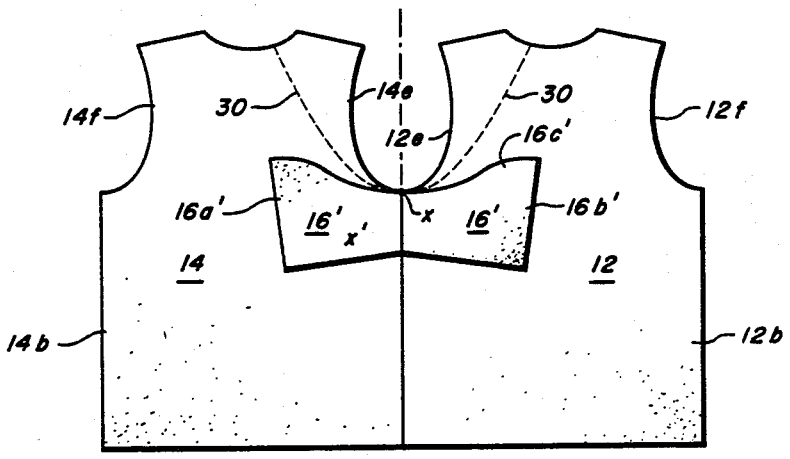
FIG. 5 shows a modified pattern for the garment of FIG. 1.

Following the making of the converted sleeve patterns 16′, the front and back patterns from the garment are arranged in a plane with their side portions 12*a* and 14*a* joined, forming the first planar pattern as shown in FIG. 5. In some embodiments, these front and back patterns may be but a single composite body first pattern. The regions 12*e* and 14*e* then define the perimeter of a shoulder hole. Similarly, the regions 12*f* and 14*f* define the perimeter of another shoulder hole.

Figure 6:
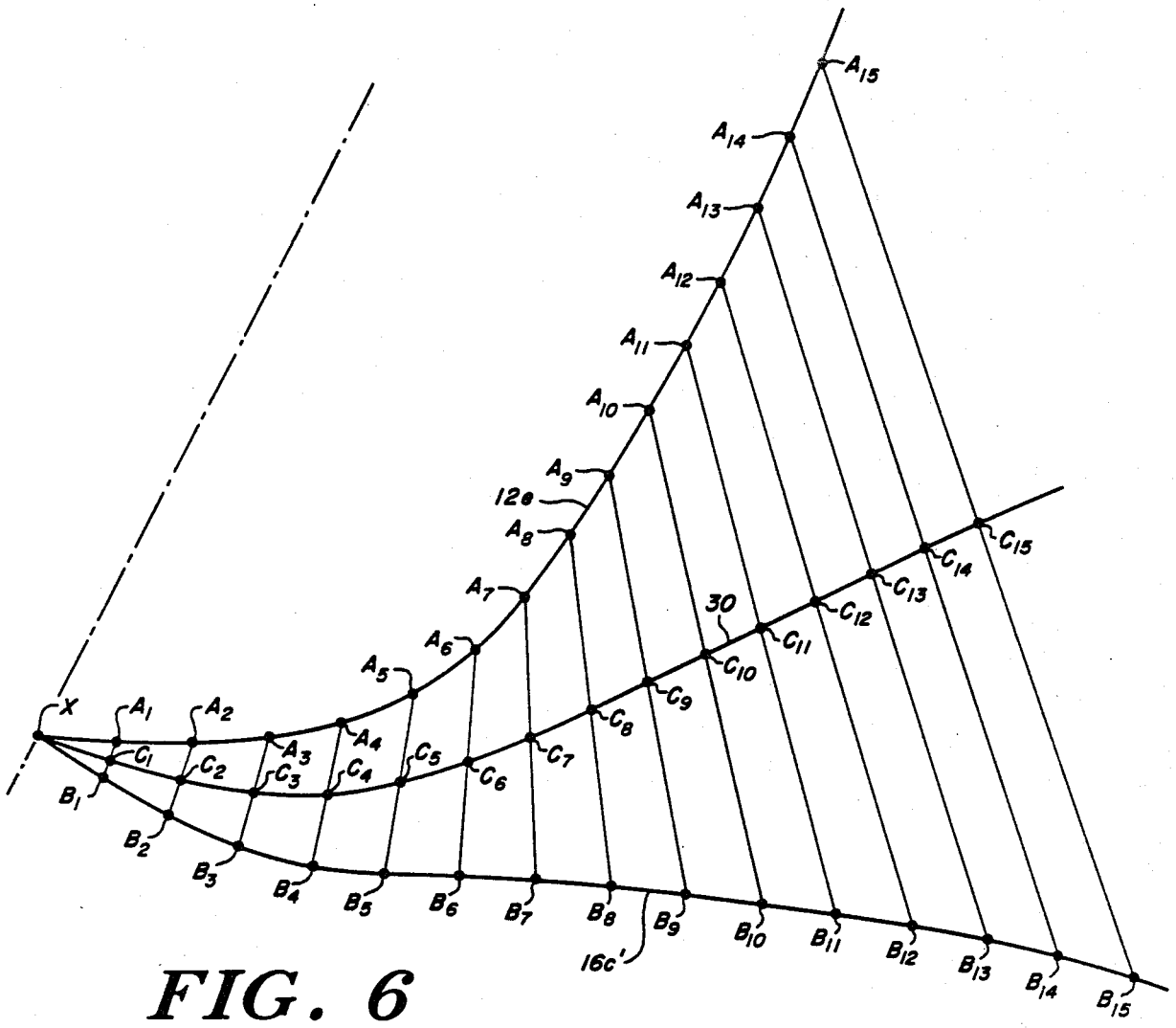
FIG. 6 illustrates the construction of the reference line for use with the pattern of FIG. 5 in accordance with the present invention.

As shown in FIG. 5 the first pattern 16′ is then overlayed onto the composite pattern formed by patterns 12 and 14, with the center point X of the region 16*c*′ positioned for its joinder at the lowermost point of the perimeter of the shoulder hole, that is, at the junction point of regions 12*e* and 14*e*. Then, a reference line 30 is identified in the plane of the patterns 12 and 14, where that reference line is defined by the midpoints of line segments connecting associated pairs of points along the shoulder hole perimeter and the region 16*c*′, where the associated points are equidistant along the contours from the center point X. By way of example, FIG. 6 shows a detailed construction of the reference line 30 with respect to the region 16*c* and the contour 12*e* with example of FIG. 5. In that FIG. 6, 15 sets of associated points are shown, denoted by points $A_i$ and $B_i$, where i goes from 1 to 15. The midpoints of the lines defined by those associated points are denoted in FIG. 6 by $C_i$. Those mid points define reference line 30. In other embodiments, the distances from the points of the pairs to the midpoint (x) may be a fixed ratio other than 1, for example where easing is be incorporated into the seam.

After construction of reference line 30, two planar patterns, the third planar pattern, are then determined for use in the construction of the desired garment. One of these patterns, the third planar pattern corresponds to the patterns 12 and 14 less the area between the reference lines 30 and the perimeter of the shoulder hole defined by regions 12*e* and 14*e*. The second of these patterns, the fourth planar pattern, corresponds to the planar pattern 16′ plus the area between the region 16*c*′ and the reference line 30. The first of these patterns corresponds to the body portion of the new garment and the second corresponds to the sleeve and shoulder portions of that garment. Although the description so far has been directed to a single shoulder hole, as shown in FIG. 5, it will be understood that a similar sleeve and shoulder portion may be identified for the other shoulder hole defined by regions 12*f* and 14*f*.

Figure 7:
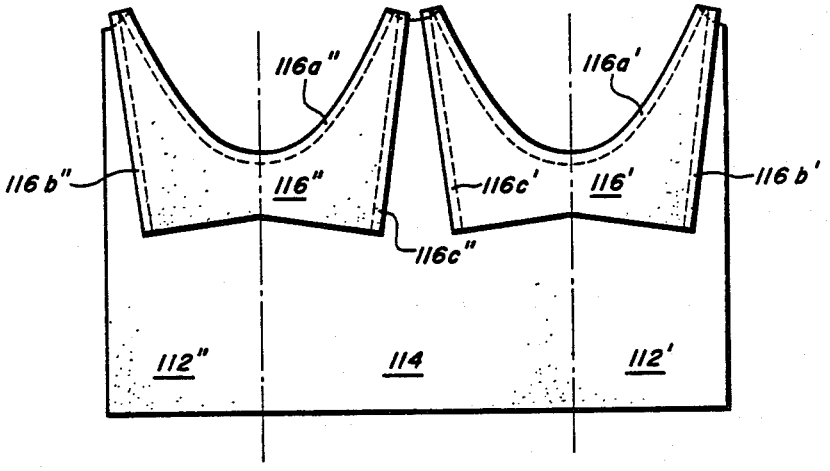
FIG. 7 shows a pattern for a garment in accordance with the present invention.

This may be readily seen from FIG. 7 which is adapted for a somewhat different garment, where the front portion 12 has a slit extending from the neck region to the bottom so that the finished garment is a smock with a back (panel 114′) and an open front (comprising panels 112′ and 112″) rather than a shirt with a closed front as with the garment of FIG. 5*b* when seams 12*b* and 14*b* are joined. The smock arrangement is shown in FIG. 7 with the back portion 114′ joined to two halves of the front portion denoted 112′ and 112″. With this configuration, the composite patterns formed by patterns 112′, 112″ and 114 are shown arranged in a planar configuration, with the sleeve and shoulder portions 116′ and 116″ as determined from the above-referenced steps in conjunction with FIG. 5, are shown also in a planar form overlying the patterns 112′, 112″ and 114. The region 116*a*′ overlies a similar region upon the patterns 112′ and 114. These regions correspond in shape to the reference line 30 of FIG. 5. Similarly, the region 116*a*″ overlies an associated region of patterns 112″ and 114.

To assemble the desired garment, the shoulder-to-body seams may be readily joined using flat plane joining techniques along the regions 116*a*′ and 116*a*″. Thereafter, the garment may be folded and the regions 116*b*′ and 116*c*′ may be joined using planar techniques to form the left sleeve, and the garment may be folded so that the right sleeve may be formed by joining regions 116*b*″ and 116*c*″ using planar techniques.

Figure 8:
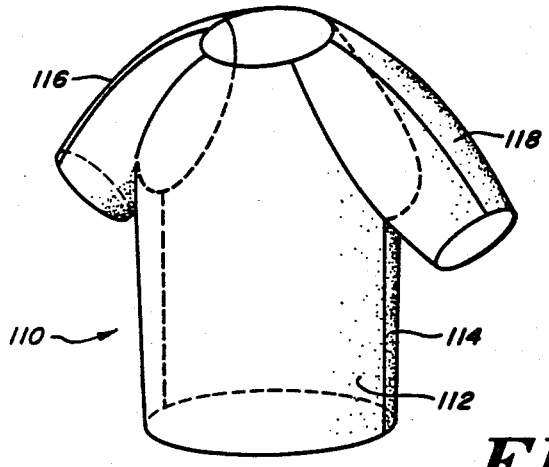
FIG. 8 shows a garment in accordance with the present invention.

As a consequence, the finished garment 110 includes front and back body portions with a shoulder holes between those front and back body portions. Separate and generally tubular sleeve and shoulder portions having a sleeve and shoulder seams extending along their length, have one end of the sleeve and shoulders portion being joined to the perimeter of the respective shoulder holes along shoulder-to-body seams. This latter garment 110 is characterized in that the regions of the body portions adjacent to the shoulder-to-body seam are substantially parallel to the regions of the shoulder and sleeve portion adjacent to the shoulder-to-body seam when the regions of the body portion are positioned in a plane (i.e., with the sleeve seam opened). The garment is shown in FIG. 8, and has substantially the same outer contour as the garment shown in FIG. 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. Method for converting a pattern for a first garment to a pattern for a second garment, wherein said first garment includes front and back body and shoulder portions with a shoulder hole between those front and back portions, and a separate, generally tubular sleeve portion having a sleeve seam extending along its length, one end of said sleeve portion being joined to the perimeter of said shoulder hole along a sleeve-to-shoulder seam whereby the regions of said sleeve portion adjacent to said sleeve-to-shoulder seam are non-parallel with respect to regions of said body and shoulder portions adjacent to said sleeve-to-shoulder seam when said body and shoulder portions are positioned in a plane, wherein, said first garment pattern includes at least one first planar pattern corresponding to said front and back body and shoulder portions positioned in a plane and a second planar pattern corresponding to said sleeve portion positioned in a plane without its sleeve seam being joined, and wherein said second garment includes body portions including front and back body portions with a shoulder hole between those front and back body portons, and a separate, generally tubular sleeve and shoulder portion having a sleeve and shoulder seam extending along its length, one end of said sleeve and shoulder portion being joined to the perimeter of said shoulder hole along a shoulder-to-body seam, and wherein the regions of said body portions adjacent to said shoulder-to-body seam are substantially parallel to the regions of said shoulder and sleeve portion adjacent to said shoulder-to-body seam when said regions of said body portion adjacent to said sleeve-to-shoulder seam is positioned in a plane without the sleeve and shoulder seam being joined, and wherein the regions of the said body portions adjacent to said sleeve-to-shoulder seam are non-parallel with respect to the regions of said shoulder and sleeve portion adjacent to said sleeve-to-shoulder seam when said regions of said body portions adjacent to the said sleeve-to-shoulder seam are positioned in a plane with said sleeve and shoulder seam being joined, wherein said second garment pattern includes at least one third planar pattern corresponding to said front and back body portions positioned in a plane and a fourth planar pattern corresponding to said sleeve and shoulder portion positioned in a plane without its sleeve and shoulder seam joined, wherein the outer contour of said first garment is substantially the same as the outer contour of said second garment, comprising the steps of:

A. generating a fifth planar pattern from said second planar patter, said fifth planar pattern corresponding to said sleeve portion wherein the sleeve seam of said sleeve portion is adapted to extend from the uppermost point of said shoulder hole, said fifth planar pattern including an end portion having a perimeter corresponding to the perimeter of said sleeve hole, B. overlaying said fifth planar pattern on said first planar pattern with the center point of said perimeter of said end portion of said fifth planar pattern being positioned for its joinder to the lowermost point of said perimeter of said shoulder hole portion of said first planar pattern, said first and fifth patterns lying in substantially parallel planes, C. identifying a reference line in the plane of said first planar pattern, said reference line being defined by the mid-points of line segments connecting pairs of associated points on said perimeter of said end portion of said fifth pattern of pattern and said perimeter of said shoulder hole of said first pattern, the distances from the points in each pair of associated points from a respective one of said lowermost and center points being a relatively fixed ratio, said distances being measured along the contours defined by said perimeter of said shoulder hole of said first pattern and said perimeter of said end portion of said fifth pattern, respectively, D. generating said third planar pattern having areas corresponding to said first patterns less the area between said reference line and said perimeter of said shoulder hole of said first planar pattern, E. generating said fourth planar pattern having an area corresponding to said fifth planar pattern plus the area between said reference line and said perimeter of said end portion of said fifth planar pattern.

2. The method according to claim 1 wherein said fixed ratio is 1.

* * * * *

UNITED STATES PATENT AND TRADEMARK OFFICE

CERTIFICATE OF CORRECTION

PATENT NO. : 4,532,655

DATED : August 6, 1985

INVENTOR(S) : Philip N. Bowditch

It is certified that error appears in the above-identified patent and that said Letters Patent is hereby corrected as shown below:

Column 2, line 45, replace "bady" with -- body --.

Column 3, line 68, replace "itselg" with -- itself --.

Column 5, line 19, replace "first pattern" with -- fifth pattern --.

Column 5, line 42, replace "third planar pattern," with -- third and fourth planar patterns, --.

Column 5, line 15, replace "composite body first pattern" with -- composite body pattern --.

Column 5, line 29, replace "composite pattern" with --composite first pattern --.

Signed and Sealed this

Ninth Day of December, 1986

*Attest:*

DONALD J. QUIGG

*Attesting Officer*

*Commissioner of Patents and Trademarks*